United States Patent [19]

Hinshaw

[11] Patent Number: 4,846,392

[45] Date of Patent: Jul. 11, 1989

[54] CONTINUOUSLY VARIABLE SPEED, DIE-DRAWING DEVICE AND PROCESS FOR METAL, COMPOSITES, AND THE LIKE, AND COMPOSITIONS THEREFROM

[75] Inventor: John W. Hinshaw, Garden Grove, Calif.

[73] Assignee: Hinshaw Experimental Laboratories Limited Partnership, Bell Gardens, Calif.

[21] Appl. No.: 208,112

[22] Filed: Jun. 17, 1988

[51] Int. Cl.[4] ..... B23K 31/06; B23K 31/08; B21G 1/00; B21H 9/00

[52] U.S. Cl. ..... 228/147; 228/150; 228/155; 228/173.7; 228/13; 228/16; 228/17; 228/17.5; 228/18; 219/61.2; 72/367; 72/368; 72/206; 72/250; 72/260; 72/276

[58] Field of Search ..... 228/147, 150, 155, 173.7, 228/16, 17, 17.5, 18, 13; 219/61.2, 59.1; 72/367, 368, 260, 276, 206, 250

[56] References Cited

U.S. PATENT DOCUMENTS

| | | | |
|---|---|---|---|
| 3,361,319 | 1/1968 | Sato et al. | 228/17.5 |
| 3,524,245 | 8/1970 | Searing | 228/17.5 |
| 3,701,270 | 10/1972 | Matthews | 72/276 |
| 3,717,458 | 2/1973 | Lesko | 72/276 |
| 3,920,173 | 11/1975 | Salata | 228/17 |

FOREIGN PATENT DOCUMENTS

| | | | |
|---|---|---|---|
| 2522070 | 12/1975 | Fed. Rep. of Germany | 72/250 |

*Primary Examiner*—Nicholas P. Godici
*Assistant Examiner*—Samuel M. Heinrich
*Attorney, Agent, or Firm*—Willie Krawitz

[57] ABSTRACT

A die-drawing and/or extrusion device is described for producing uniform and tapered metal and composite tubes from flatstock and for reducing the size of solid stock and formed tubes therefrom, and lamination of compatable materials in one operation. The die comprises opposed die elements having curved helical tracks or grooves which follow a central orifice through which the flatstock, solid stock, tubes, etc., are pulled and/or pushed. Wedge-shaped shaping and alignment elements are positioned in the helical tracks in contact with the dies to align the feedstock with the die orifice, and to prevent the metal sheet or tube, rod, etc., from being drawn in between the tangential surfaces of the dies. The extent of product taper is determined by the pull rate applied to the feedstock in conjunction with the rotational rate of the dies, which can be varied continuously. The process results in a cold drawing of the feedstock, without galling or crushing the product, and this produces metal and composite articles having improved physical properties.

23 Claims, 3 Drawing Sheets

CONTINUOUSLY VARIABLE SPEED, DIE-DRAWING DEVICE AND PROCESS FOR METAL, COMPOSITES, AND THE LIKE, AND COMPOSITIONS THEREFROM

BACKGROUND OF THE INVENTION

This invention relates to a new and improved die-drawing and/or extruding device, primarily for converting flat metal and composite stock into formed slit tubing which may be subsequently welded to form a tube having seamless characteristics. In addition, flat stock tubes or solid stock can be formed either with a tapered, spiralled, ribbed or uniform shape, and depending on the shape of the dies, the formed work piece can assume a variety of shapes such as circular, hexagonal, square, triangular, D-section, rectangular, I-beam, etc., with combinations of the above, and transitional areas therebetween.

While the use of flat metal represents one form of feedstock, ready made tubes can also be processed for purposes of size reduction as a uniform shape, or in a tapered form, either step tapered, reverse tapered, as a venturi shape, as a continuous stream of pre-defined shapes, etc.

In addition, solids, laminates, plastic-coated metals, and composites, all in various cross sectional shapes may be formed or modified by the process of this invention.

Many prior art patents disclose the general process of drawing flat stock, tubes, rods and the like through rotating dies, rolling mills, and so forth. Typical publications in this field are U.S. Pat. Nos. 433,580; 860,879; 989,508; 1,178,812; 1,200,304; 1,455,652; 1,652,396; 1,700,508; 2,780,948; 3,274,816; 3,452,424; 3,650,138; 3,895,510; 3,938,724; and, 4,578,985.

Prior art patents of the inventor herein include: U.S. Pat. Nos. 3,327,513; 3,564,884; 3,585,832; 3,593,559; 3,596,491; 3,605,476; and, 3,540,259.

Some disadvantages posed by these prior art patents are that the feedstock is subject to a crushing action, and this can produce galling, embrittlement and stress cracking of the material. While subsequent straightening, annealing and cleaning operations may be employed to relieve some of these defects, they involve extra, expensive steps, and reduce the aesthetic appearance of the product. Furthermore, the prior art requires a series of intermediate operations preparatory to final sizing and shaping.

An object of this invention is to provide a new and improved drawing and/or etrusion device and process, primarily for drawing and/or extruding flatstock, tubes, solids, and the like to produce a constant size, uniform, or concave or convex tapered product having improved strength characteristics, and fewer structural and surface imperfections.

A further object of this invention is to form tubular products such as laminates, plastic feedstock, tubes and rods, plastic covered metal, multiple tubes from two or more flatstock sheets, and so forth.

A further object is to eliminate the requirement of swaging and/or pointing operation prior to drawing.

Another object is to form an incomplete tube employing the drawing apparatus of this invention which can then be readily welded.

THE INVENTION

According to the invention, there is provided a die-drawing apparatus and process comprising two or more rotatable, adjacent, matched or unmatched die elements located between helical tracks or grooves thereon. An orifice is defined between opposed grooves of each die, and flatstock, tubes, solids, etc., is passed through the orifice to be formed, or to obtain a size reduction of constant diameter, a tapered shape, or both.

It has been found that the simultaneous rotation of the dies while pulling the feedstock through the orifice (by gripping means), minimizes galling, embrittlement and stress cracking, and produces products having greatly improved tensile strengths and hardness, and reduces prior stress conditions.

In addition, alignment means are provided to ensure the feedstock is properly aligned as it is drawn through the die orifice, and this results in a more even flow of material which results in products having more uniform characteristics.

The alignment means includes curved, wedge-shaped feed and alignment elements which are fitted closely adjacent to, or in contact with the grooves of the dies, and are configured to form a rolling contact with the entrance to the die orifice. The feed and alignment elements prevent the feedstock from escaping from other than the perimeter of the die orifice. To accommodate for variations in die closure slope, the curved wedge-shaped feed and alignment elements are mounted for movement on a support plate. The coincident movement of the wedge elements on the support plate produces an equivalent timed (or coincident movement) of the die elements. Hence, the feedstock will move through the dies only when the dies are moving in timed coincidence.

About midway of the support plate is defined a slot axially aligned with the die orifice and is sized and configured to the width of the feedstock, and positioned centrally and axially of the die orifice. On one side of the support plate is mounted the curved, wedge-shaped feed and alignment elements. Also, the pulling means for drawing the feedstock through the dies employs a pulling motion which is centrally and axially aligned with the die orifice.

Consequently, a controlled alignment of the feedstock is maintained as it passes through the dies. The overall result is that a more uniform drawing process is achieved, and this works in conjunction with the operation of the dies to achieve a cold drawn product with improved physical characteristics.

Figure 1:
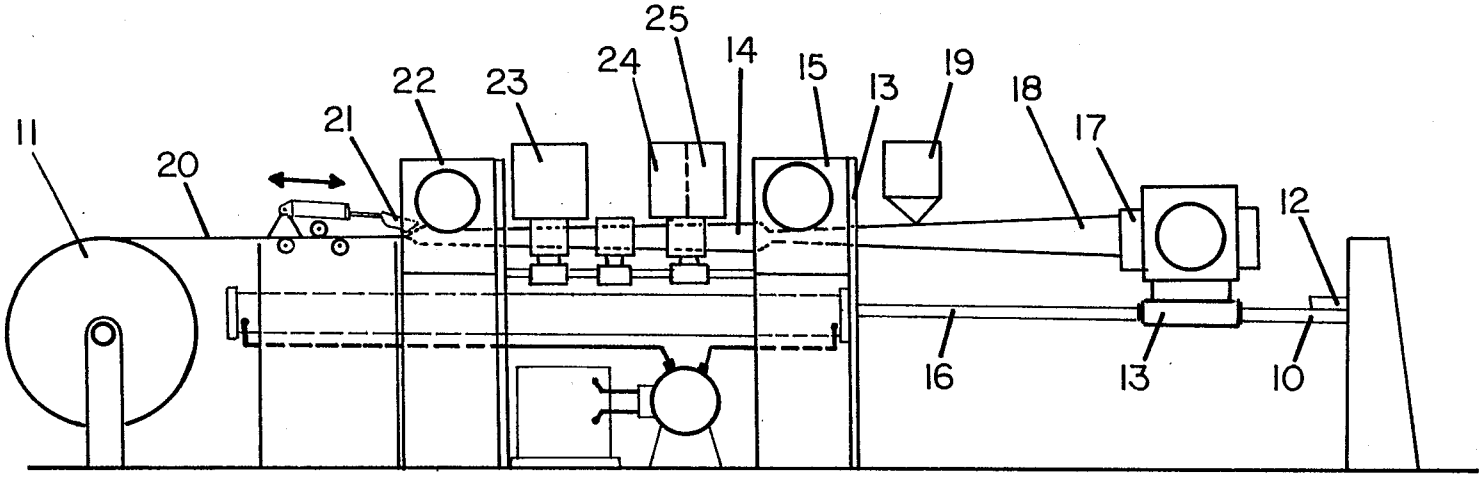
FIG. 1 is a schematic, side elevation view showing an overall flow diagram and location of the die elements of this invention.
Figure 4:
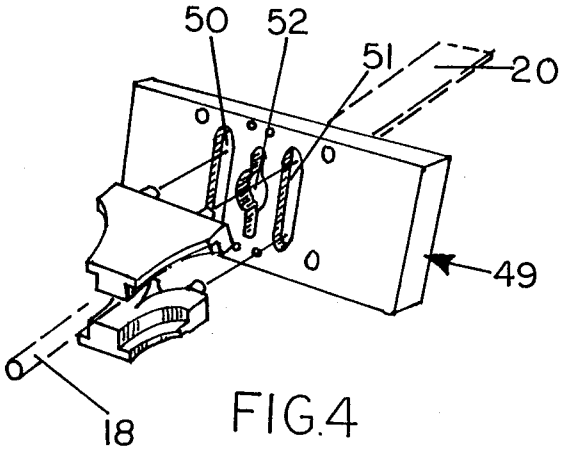
FIG. 4 is a perspective view showing the mounting plate for the wedge-shaped alignment elements; and, FIG. 5 is a perspective view showing a portion of a rolled tube from flatstock.
Figure 3:
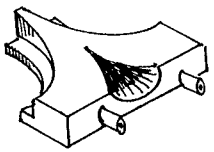
FIG. 3 is a perspective view of an alignment element.

DESCRIPTION OF THE PREFERRED EMBODIMENTS:

A schematic view of the apparatus of this invention is shown in FIG. 1, and comprises a support track 10, with a stock decoiler 11 at one end, and stop means 12 at the other end thereof. A moveable trolley 13 is mounted on the support track and functions to draw a hollow or solid workpiece 14 through a rotatable die system 15. The trolley is driven by a hydraulic powered means 16. A power actuated gripper device 17 is carried by the trolley for engaging the workpiece prior to, and during the drawing operation, and for releasing a finished workpiece 18 when it has been completed or severed in a cut-off device 19. The gripping device is adjustable to approximate for variations in dimensions of the rotating die system which produces products of varying sizes. It will be appreciated that while only two dies are shown being utilized to form and shape plate, hollow and solid products, etc., additional die elements, say three or more, may be used for larger sized stock, where appropriate. A common or independant power source may be employed for rotating the dies.

Flat work stock or preformed hollow stock 20 from the decoiler 11 is passed over an adjustable mandrel 21 (for wall sizing), and an adjustable tubulator 22 (to provide an initial reduction to constant size), and then welded closely by a high frequency welder 23 and forge rollers 24. The welded tube is then passed through an annealer 25, if desired, and as indicated, is then passed through the die system 15 of this invention for drawing either to a constant diameter or down or up a taper. If desired, the welder can be elminated, and the product is passed through the die system 15 in the form of an open channel of given configuration such as "Z", etc., either constant, down or up a taper.

Figure 2:
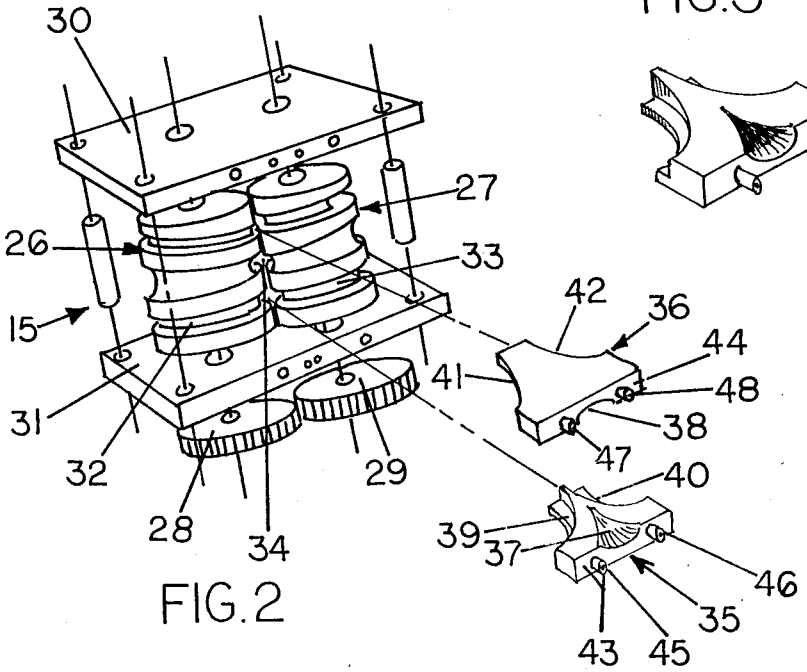
FIG. 2 is an exploded, perspective view of the assembled dies and wedge-shaped alignment elements of this invention.

The die elements 26, 27 of this invention are illustrated in FIG. 2, and have rotational speeds which may be varied continuously. The dies are constructed of appropriate metals such as brass, chilled cast iorn, tool steel, etc., and are mounted (e.g. by spline connections) to matched gears 28, 29 mounted within stanchion plates 30, 31. If desired, a pushing system (e.g. an extrusion press) may be used either alone or in conjunction with a pull through system, such as the trolley 13 and gripper 17.

The dies provide matched, opposed, helical grooves 32, 33 which define a central die orifice 34, and the extend of taper of the finished workpiece 18 is determined by the rate of closure of the dies relative to the draw rate through the die orifice produced by the trolley 13, and by the tubulator 22. This enables specific widths of flatstock to be formed into tubes having different diameters, without necessitating changing the dies or the flatstock, and this of course applies to open-channel material. For a constant size product, the dies are fixed at the desired dimension of the die orifice. It will be appreciated that the components of the tubulator 22 and rotating die system 15 are the same, the tubulator imparting size reduction, and the dies imparting a taper and/or final sizing to the workpiece.

To ensure the tubular workpiece is properly aligned at the die orifice, opposed wedge-shaped feed and alignment elements 35, 36 are mounted to form a bearing surface with the entrance to the die orifice 34. The alignment elements 35, 36 also function to prevent the workpiece from escaping from other than the die orifice as the workpiece is being formed, and cause the flat stock to curl into a circular shape prior to engaging the die orifice.

Each alignment element 35, 36 defines matched, central, tapered cut-out sections 37, 38 which, when opposed, enclose the workpice as it moves through the die orifice 34. The matching lands 39, 40 and 41, 42 of the respective alignment elements 35 and 36 are configured to fit into the helix grooves 32, 33 of the die elements. This arrangement enables the alignment elements 35 and 36 to be positioned against the entry to the die orifice 34, and along the helix grooves 32, 33 and forming bearing contact surfaces therewith. The alignment elements are held in place by the shape of the helix grooves and/or a retainer piece and cause the rotatable dies to be automatically held 'in time' with each other.

The rear ends 43 and 44 of each feed and alignment element are provided with corresponding bearing mounts 45, 46 and 47, 48 which fit into a support plate 49 along grooves 50, 51. These may be omitted by use of retainer pieces and/or close machining tolerances. Movement of the alignment elements, depending on the extent of rotation of the dies, will be accommodated by movement along the helix grooves 50, 51..

A central orifice 52 that is sized for passage of the workpiece is defined on the support plate 49. The central orifice 52, alignment elements 35 and 36, die orifice 34, and the trolley 13 are all closely aligned axially and centrally to effect a uniform pull-through of the workpiece. The overall result is the production of a product having uniform dimensional characteristics, with enhanced smooth, almost polished, uniform surface, with no galling. The feedstock may be pulled through the dies at an incline thereto, and bending the product. Thus, if desired, curved and/or spiralled products may be produced by drawing or extruding the workpiece through the die system and exerting a side force perpendicular to the central line of the workpiece proportional to the desired spiral radius and the desired coil separations.

Figure 5:
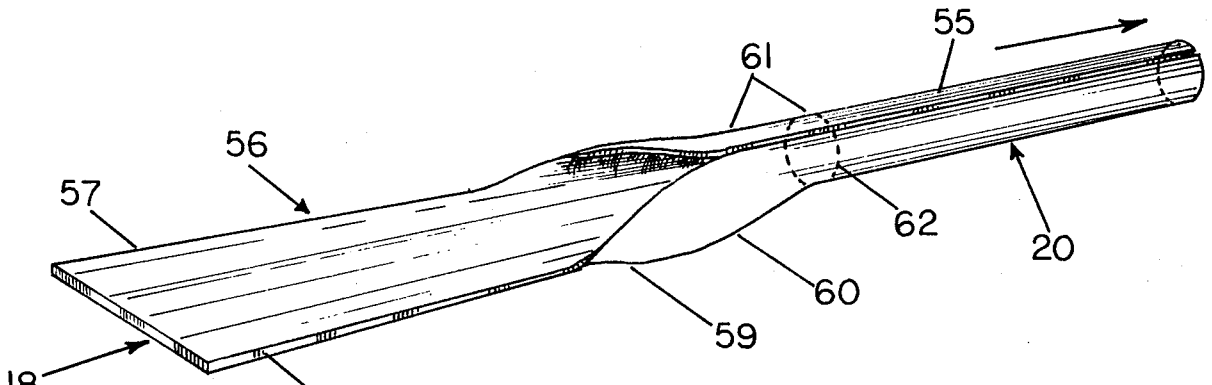

A portion of the finished workpiece is shown in FIG. 5, and comprises a finished tube 55 from flatstock, a portion 56 of which is shown for illustrative purposes. The flatstock defines edges 57, 58 which form a uniform slit upon rolling having these edges in close and aligned registry, i.e., sufficiently close to enable production of a suitable weld. As the flatstock is pulled through the dies in the direction shown by the arrow, it is initially deformed 59 ahead of the first contact with the alignment elements 35, 36, and begins to roll. As the partially rolled tube 60 passes through the dies 26, 27, it assumes its final shape 55 in the die working band region 61, and then exits the die shown by the circle 62.

A typical tube drawing process produced by the apparatus of this invention, using 304 stainless steel formed in a single pass from a pierced billet, followed by tube reduction, cold drawing and annealing, enables production rates of about up to about 300 feed/minute, e.g., about 10–300 feet/minute, and forms tubes with up to about 65% reduction in area, having a wall thickness of about 4 mils to ½", and a diameter of about 300 mils to 4½". Other metal types would, of course, require a corresponding change in process parameters for the same dimensioned tubes.

While the process of this invention is carried out typically at room temperature, the products may be hot worked up to about 1800° F.–2100° F.

The process of this invention can employ flat sheet stock, solids, or ready-made hollows. In the case of flat stock, the process produces an incompletely formed tube with a sufficiently narrow, uniform slit to enable welding the final formed tube. In addition, two or more flatstock sheets or tubular stock may be formed simultaneously into multiple layered (laminated) tubes of different alloys and metal compositions. Thus, metal laminates, plastic coated metals and plastic tubes and rods may be formed, whether alone or as laminates. This results in higher strength products with thinner combined walls than corresponding monowalled tubes. Solid stock can also be laminated over to enhance the appearance and corrosion resistance. The mechanical bond thus created resists failure of the inner laminate due to accidental damage to either of the laminates.

While the apparatus and process of this invention is directed primarily to relatively large size tubes and rods, wires and hollow needles from about 12–36 gauge also may be formed. Moreover, the apparatus may be programmable to produce different cross-sectional configurations, as described, supra, such as for light standard poles, golf clubs, I-beams, bar stock, rectangle shapes, etc.

Various types of materials which may be worked by the process and apparatus of this invention include pvc, polypropylene, nylon, polyester, rubbers, etc., whether alone or reinforced with metal, fiberglasss, graphite fibers, metal wire (Al, steel), etc.

In general, ferrous, non-ferrous, super alloys and refractories may be worked by the process and apparatus of this invention. Typical materials which have shown significant strength and hardness improvement are: 304 stainless steel, N-155, INCO 625, AM-362, Aluminum (7075-T6; 2024-T3), brass (65Cu-35Zn), copper, carbon steel, 6Al-4V-Ti alloy, Rene 41, columbium and tantalum.

Using the apparatus and process of this invention obtained test results for some of the above materials, as follows:

| S/N | MATERIAL | THICKNESS INCH | BRINELL HARDNESS | STRENGTH PSI |
|---|---|---|---|---|
| 1. | Columbium | 0.034 | 156–172 | 85,000 |
| | Hastelloy | 0.022 | 342–362 | 170,000 |
| | 304 S/S | 0.019 | 290–362 | 160,000 |
| | N-155 | 0.049 | 260–270 | 125,000 |
| | N-155 | 0.028 | 382–426 | 200,000 |
| | Inco 625 (A six layer sample) | 0.101 | 426–484 | 230,000 |
| | Columbium* | | 80 | 40,000 |
| | Hastelloy* | | 195 | 120,000 |
| | 304 S/S* | | 175 | 85,000 |
| | N-155* | | 190 | 90,000 |
| | Inco 625* | | 260 | 125,000 |
| *original material, assuming commercial annealing | | | | |
| 2. | 7075-T6 | 0.039* | 151–157 | 85,000 |
| | | 0.041 | 226–236 | 120,000 |
| 3. | 304 S/S | 0.070* | 172–205 | 90,000 |
| | | 0.054/068 | 322–362 | 165,000 |
| 4. | 304 S/S | 0.049* | 141–172 | 75,000 |
| | | 0.040/052 | 322–362 | 165,000 |
| 5. | 304 S/S | 0.062* | 169–185 | 85,000 |
| | | 0.058/064 | 322 | 160,000 |
| | Brass | 0.067* | 96–109 | 50,000 |
| | | 0.070 | 148–157 | 85,000 |
| (304 stainless steel tube formed over yellow brass tube) | | | | |
| 6. | AM-362 | 0.035* | 234–240 | 110,000 |
| | | 0.038 | 313–332 | 155,000 |
| | | 0.036 | 313–342 | 160,000 |
| 7. | N-155 | 0.020* | 255 | 120,000 |
| | | 0.020 | 260–332 | 140,000 |
| 8. | Copper | 0.044/045 | 75 | 40,000 |

-continued

| S/N | MATERIAL | THICKNESS INCH | BRINELL HARDNESS | STRENGTH PSI |
|---|---|---|---|---|
| | | 0.044/045 | 95–104 | 55,000 |
| 9. | Carbon | 0.047* | 116–141 | 65,000 |
| | | 0.046/048 | 162–176 | 80,000 |
| 10. | 6Al-4V-Ti | 0.059/060* | 172–200 | 90,000 |
| | | 0.060/065 | 195–205 | 95,000 |
| 11. | Rene' 41 | 0.033* | 150–176 | 75,000 |
| | | 0.037 | 382–426 | 200,000 |
| | | 0.035+ | 382–415 | 200,000 |

*These values are for original material in each case.

The above data indicate that it is possible to form some material considered to be difficult or impractical, and include aluminum such as 7075-T6 aluminum, 6Al-4V-Ti, Inconel 625 and Rene' 41.

Other materials can be formed, without intermediate annealing, to hardness levels considered to be beyond traditional methods, These materials includes columbium, 304 stainless steel, N-155 and AM-362.

The process of this invention does not necessitate use of a mandrel. However, a tapered mandrel may be employed (as shown) in the process for the purpose of controlling wall thickness and to produce a tapered inner wall, while the die orifice controls the outer wall shape of the tube.

It is obvious that since the profile of the die is tapered, when a constant shaped product is being formed, and die wear occurs, the dies can simply be rotated to compensate for this wear, rather than requiring replacement or reworking.

I claim:

1. An appparatus for shaping feedstock, comprising:

a. feeding means for the feedstock;

b. at least two matched, counterrotating die elements adapted for opposed, rolling contact with each other, each element defining a peripheral groove thereon and, a central die orifice;

c. opposed feed and alignment elements shaped to provide a bearing contact with the orifice at an entrance thereof, and with the grooves of the dies, the said feed and alignment elements being configured to enable feeding of the feedstock into the die orifice and for shaping between opposed, adjacent grooves, without spalling into the dies, the alignment elements being adapted for movement in response to movement of the dies;

d. a support for the feed and alignment elements, the support defining a feedstock orifice shaped to accommodate the feedstock;

the feeding means, central die orifice, feed and alignment elements, and feedstock orifice being aligned to enable movement of the feedstock through the dies and die orifice; the shaped product having a uniform polished surface, without galling or crushing.

2. The apparatus of claim 1, including welding and hot rolling means to produce tubular articles from an incomplete tube.

3. The apparatus of claim 1, including tubulator means for shaping the feedstock internally.

4. The apparatus of claim 1, including a trolley for pulling the feedstock through the dies, movement of the trolley, the die orifice, feed and alignment elements and feedstock orifice being aligned.

5. The apparatus of claim 1, in which the central die orifice is shaped to provide a corresponding, external shaped product.

6. The apparatus of claim 1, in which the feed and alignment elements are supported at one end thereof by the said support, and are adapted for movement therealong to accommodate for rotational movement of the dies.

7. The apparatus of claim 1, in which the feed and alignment elements are wedge-shaped.

8. The apparatus of claim 1, in which the peripheral grooves of the dies are of uniform depth.

9. The apparatus of claim 8, in which the peripheral groove of the dies are formed as a right, cylidrical helix.

10. The apparatus of claim 1, in which the shape of the central die orifice includes: rectangular, D-shaped, I-beam, square, circular, hexagonal, triangular, combinations of the above, and transitional areas therebetween.

11. The apparatus of claim 1, in which the dies are adapted to move in timed sequence, thereby permitting feedstock to move therethrough.

12. The apparatus of claim 1, including an adjustable mandrel adapted to control wall thickness or produce a tapered wall.

13. The apparatus of claim 1, in which the die elements have rotational speeds which may be varied continuously.

14. A process for shaping feedstock comprising:

a. advancing the feedstock through at least two, matched counter rotating die elements adapted for opposed, rolling contact with each other, each element defining a peripheral groove thereon and, a central die orifice;

b. providing opposed feed and alignment elements shaped to produce a bearing contact with the grooves and the die orifice at an entrance thereof, the said feed and alignment elements being configured to enable feeding of the feedstock into the die orifice and for shaping between adjacent, opposed grooves without spalling into the dies, the alignment elements being adapted for movement in response to movement of the dies;

c. providing a support for the feed and alignment elements, the support defining a feedstock orifice shaped to accommodate the feedstock; and, d. aligning the feeding means, central die orifice, feed and alignment elements, and feedstock orifice to enable movement of the feedstock through the dies and die orifice, thereby producing a shaped product havig a uniform, polished surface, without galling or crushing.

15. The process of claim 14, comprising cold drawing the feedstock.

16. The process of claim 14, comprising hot working the products up to about 1800° F.–2100° F.

17. The process of claim 14, comprising tube drawing at production rates of about 10–300 feet-minute, and forming tubes with up to about 65% reduction in area, having a wall thickness of about 4 mils ½", based on 304 stainless steel tubing formed in a single pass from a pierced billet followed by tube reduction, cold drawing, and annealing.

18. The process of claim 14, comprising forming laminates, plastic coated metals, plastic tubes and rods, wire, and hollow needles.

19. The process of claim 14, in which the feedstock is pulled through the dies at an incline thereto, and bending the product.

20. The process of claim 14, in which the feedstock is passed through the dies to produce a product having a uniform cross sectional area.

21. The process of claim 14, comprising welding and forging an incompletely formed tube.

22. The process of claim 14, comprising advancing the feedstock through the die elements with an extrusion press, a pull through system, or both.

23. The process of claim 14, in which the feedstock includes flatstock, tubes and rods.

* * * * *